US006998360B1

(12) United States Patent
Picard

(10) Patent No.: US 6,998,360 B1
(45) Date of Patent: Feb. 14, 2006

(54) HYDROPHILIC COTTON PRODUCT COMPRISING A SOFT SURFACE AND A SCRAPING SURFACE

(75) Inventor: Bernard Louis Dit Picard, Amfreville la Campagne (FR)

(73) Assignee: Georgia-Pacific France, Kunheim (FR)

( * ) Notice: Subject to any disclaimer, the term of this patent is extended or adjusted under 35 U.S.C. 154(b) by 205 days.

(21) Appl. No.: 10/018,050

(22) PCT Filed: Jun. 13, 2000

(86) PCT No.: PCT/FR00/01635

§ 371 (c)(1),
(2), (4) Date: Jan. 18, 2002

(87) PCT Pub. No.: WO00/76384

PCT Pub. Date: Dec. 21, 2000

(30) Foreign Application Priority Data

Jun. 16, 1999 (FR) ..... 99 07612

(51) Int. Cl.

| | |
|---|---|
| ***A47K 7/02*** | (2006.01) |
| ***B32B 5/14*** | (2006.01) |
| ***B32B 5/26*** | (2006.01) |
| ***B32B 7/08*** | (2006.01) |
| ***D06N 7/04*** | (2006.01) |

(52) U.S. Cl. ..... 442/381; 15/208; 428/98; 428/141; 428/167; 428/170; 428/171; 428/172; 442/384; 442/387; 442/414; 604/358; 604/374

(58) Field of Classification Search ..... 428/171, 428/180, 181, 192, 198, 98, 141, 167, 170, 428/172; 442/381, 408, 384, 387, 414; 15/208; 604/358, 374

See application file for complete search history.

(56) References Cited

U.S. PATENT DOCUMENTS

| | | | | |
|---|---|---|---|---|
| 4,184,499 | A * | 1/1980 | Seidler | 132/75.6 |
| 4,449,391 | A * | 5/1984 | Anthony | 73/32 R |
| 5,480,699 | A * | 1/1996 | Gerhartl et al. | 428/171 |
| 5,843,064 | A * | 12/1998 | Koczab | 604/378 |

FOREIGN PATENT DOCUMENTS

WO WO 76384 A1 * 12/2000

* cited by examiner

*Primary Examiner*—Terrel Morris
*Assistant Examiner*—Jennifer Boyd
(74) *Attorney, Agent, or Firm*—Breiner & Breiner, L.L.C.

(57) ABSTRACT

The invention relates to a hydrophilic cotton product of 100% cotton fibers and including at least one first and one second outer layers. In the invention, the first layer is of fine fibers exhibiting a low micronaire value and constitutes a soft side and the second layer is of fibers exhibiting a higher micronaire value and constitutes a scraping surface. In particular, the product of the invention applies to cosmetics for makeup deposition on and/or removal from the skin.

14 Claims, 2 Drawing Sheets

HYDROPHILIC COTTON PRODUCT COMPRISING A SOFT SURFACE AND A SCRAPING SURFACE

Figure 1:
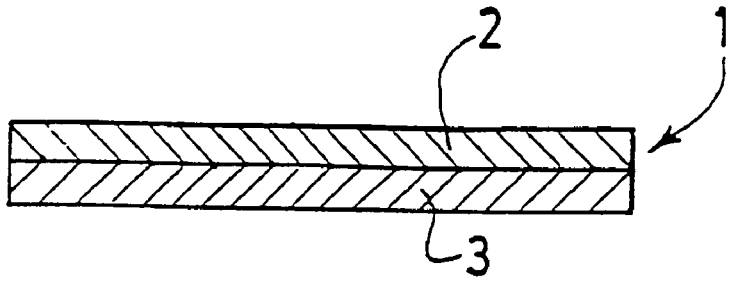

The object of the present invention is a hydrophilic product constituted 100% of cotton fibers and in particular for cosmetic purposes, namely applying and/or removing skin makeup.

Most of current marketed cotton products are cut into formats, namely into round, oval or square makeup removal means and present sides which are both identical in their fiber composition. When using such products, the two product sides cannot be distinguished when it is desired to use a particular side for makeup application by liquid application for example, such as cream, lotion or "lait de toilette", and using the other side for makeup removal by cleaning the skin by wiping and slight rubbing.

French Patent Application 0 750 062 describes skin-cleansing articles which are simultaneously soft with respect to the skin and strong enough to withstand being rubbed against the skin without thereby irritating or causing lesions in it. Rubbing the skin removes impurities and dead cells from the skin surface. These articles include a nonwoven substrate which preferably is hydraulically interlinked and of which the specific surface weight runs between 20 and 150 g/m$^2$, and this substrate is characterized by a specific coefficient of friction. Preferably this substrate includes at least in part long fibers that may escape from the main surface on account of rubbing while nevertheless remaining affixed to the substrate. This substrate may be a mixture of hydrophilic and hydrophobic fibers, or it may consist strictly of purely hydrophilic or purely hydrophobic fibers.

At least one side of the article or substrate is used for skin cleansing. This side also helps cleansing or makeup-removing products such as lait de toilette. In the event the skin-cleansing article would consist only of this substrate, its two sides would be indistinguishable and either one could be used for skin cleansing.

European Patent Application 0 851 052 describes a cotton makeup removing pad in particular for cosmetics and having at least two layers. In order to preclude loss of fibers while preserving softness and absorption, the fibers of the outer layers are longer than those of the core layer(s). The thickness of the core layer(s) preferably is greater than that of the outer ones. Again such products lack distinguishable sides allowing side-specific use.

Most cotton makeup removing products consist of a mixture of cotton fibers of different qualities or of a mixture of cotton and other fibers depending on the desired final product or manufacturing process. Such products exhibit a homogeneous composition across their full thickness. Some other products consist of several layers or sheets. However it is clear from the above that the two outer layers are always identical in composition and cannot be distinguished one from the other.

There is a need for cotton products exhibiting two different sides allowing different uses for each side, in particular for cosmetic uses, namely one side for makeup removal or skin cleansing and the other side for makeup deposition by this product to the skin.

As regards industrial cleansing by wiping, European Patent Application 0 826 811 proposes an absorbent, nonwoven complex material including one flexible side and one rough side. This material consists of at least two superposed sheets which are interlinked in their thicknesses by mutually penetrating fibers. However the first sheet consists in whole or in part of heat-melting synthetic fibers preferably selected from the polyolefin class and the second sheet consists of natural and/or artificial and/or synthetic fibers which are thinner than those of the first sheet. The synthetic fibers in the composition of the first sheet implement the article's scraping surface. This scraping effect is attained by reorienting the synthetic fibers so that their free ends emerge free or in the form of small loops on one outer side, and by melting the free ends of the synthetic fibers.

This product is not intended for cosmetic purposes but instead for gently scouring or highly absorbing wiping purposes.

An object of the invention is to create a cotton makeup removing product offering two different sides. A first side is for scraping and is intended to cleanse the skin, in particular to be used for makeup removal, for example, using a lait de toilette or a lotion. The other side is soft and allows applying a makeup product, lait de toilette, lotion or cream to the consumer's face or skin. Side differentiation is essentially by touch and optionally by sight.

Another object of the invention is to offer a "natural" product solely of natural fibers and free of artificial and/or synthetic fibers, further free of any binder, and allowing easily recycling the wastes incurred during manufacture.

The object of the invention is a hydrophilic cotton product having 100% cotton fibers and comprising at least a first and a second outer side.

In an essential feature of the invention, the first layer has thin fibers of low micronaire value which constitute the soft side and the second layer has fibers of a higher micronaire value and constitute a scraping side.

The micronaire value represents the average weight of fibers per unit length stated in $\mu$g/inch of a specimen of a tested cotton product. This value is directly linked to the mean fiber cross-section. It defines the thickness of the cotton fibers and is measured using an apparatus such as the SHEFFIELD Micronaire. This value and its measurement procedure are elucidated further below.

In a more specific feature of the present invention, the first outer layer exhibits a micronaire value between 2 and 5 $\mu$g/inch and the second outer layer exhibits a micronaire value between 4 and 10 $\mu$g/inch, the differential of the micronaire values of the two outer layers being at least 1 $\mu$g/inch.

In a preferred feature of the invention, the micronaire value of the first layer is between 2.8 and 4.2 $\mu$g/inch and that of the second layer between 5 and 8.5 $\mu$g/inch.

In another feature of the present invention, the specific surface weight of the outer layers is at least 8 g/m$^2$ for each.

In an advantageous feature of the invention, its product also comprises at least one core layer sandwiched between the two outer layers.

In order to more easily distinguish the two sides and according to one feature of the invention, the surfaces of the outer layers are striated, the spacings between the striations of one layer being less than that between the striations of the other layer.

Another object of the present invention is a process for manufacturing the hydrophilic cotton of the invention of which the outer layers exhibit striations.

In one essential feature of the invention, each outer layer is hydraulically linked using water jets of which the axes are mutually spaced in a defined manner, such spacing being different for the jets relating to the first layer and the jets relating to the second layer in such a way as to attain outer layers exhibiting differently spaced surface striations.

Other features and advantages of the invention are elucidated in the following description and in relation to the attached drawings.

Figure 2:
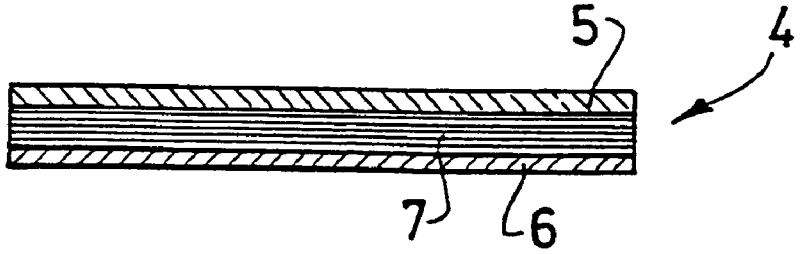
Figure 3:
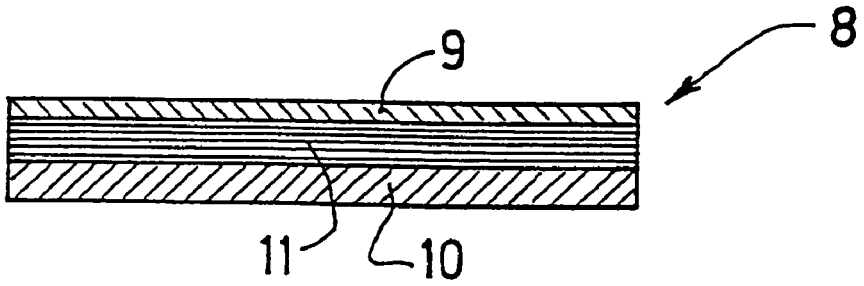
Figure 4:
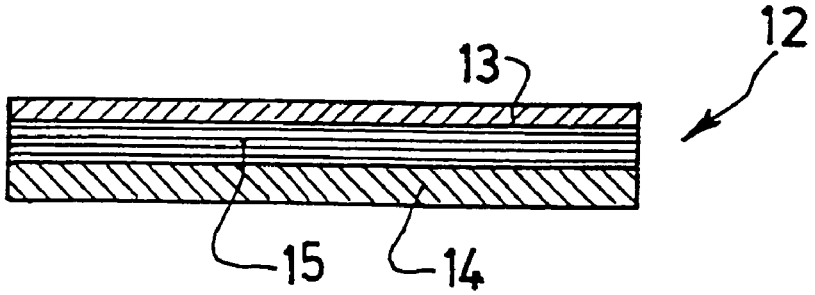
Figure 5:
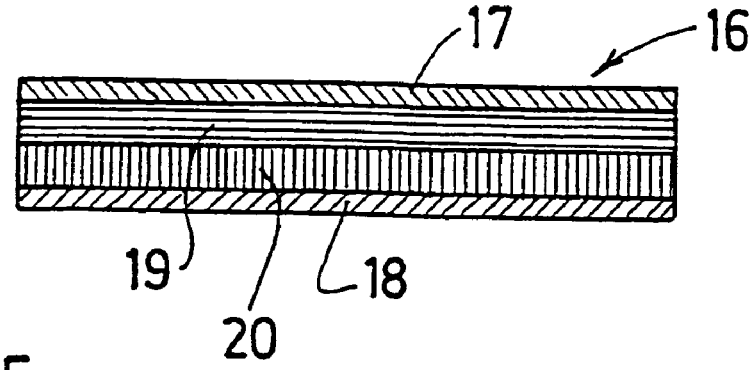
Figure 6:
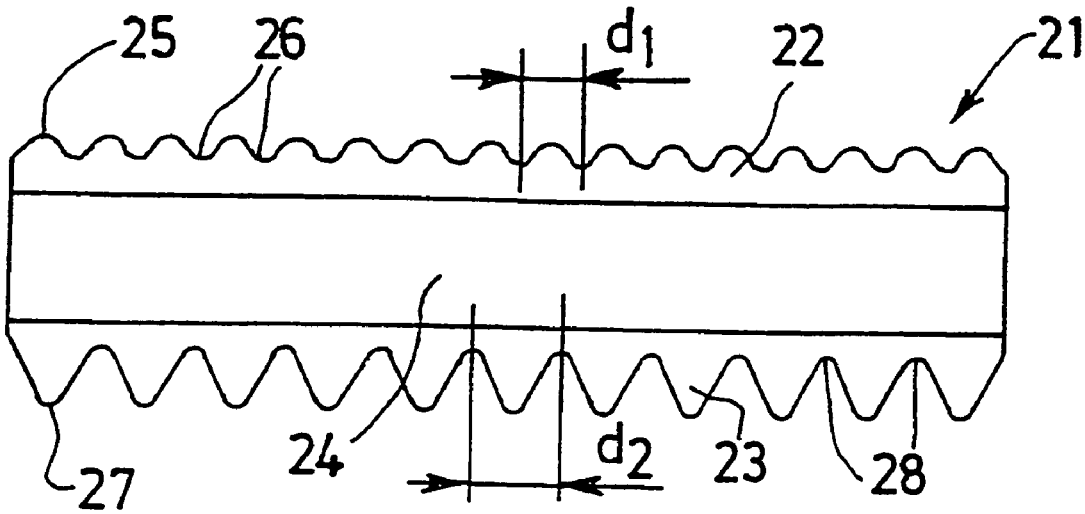
Figure 7:
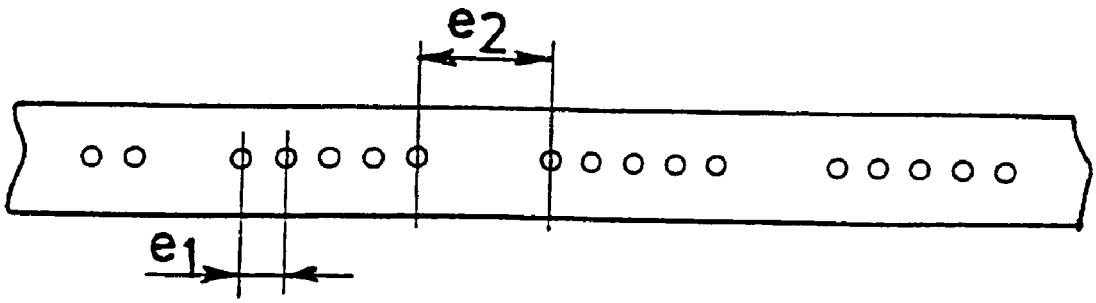

FIG. 1 is a schematic cross-section of one embodiment of the invention comprising two cotton layers, FIG. 2 is a schematic cross-section of an embodiment of the product of the invention comprising three layers, FIG. 3 is a schematic cross-section of an embodiment variation of the product of the invention shown in FIG. 2, FIG. 4 is a schematic cross-section of another embodiment variation of the product of the invention shown in FIG. 2, FIG. 5 is a schematic cross-section of a product of the invention comprising four layers, FIG. 6 shows a product of the invention which furthermore comprises sides exhibiting differently spaced striations, and FIG. 7 schematically shows the surface of a strip, which is perforated in a given sequence, of a hydraulic linking device.

The product of the invention is made of 100% cotton fibers and comprises at least two layers or sheets each exhibiting an outer side.

The first layer is thin and soft fibers of low micronaire value.

The second layer on the contrary is fibers of larger cross-section having a higher micronaire value and on that account capable of scraping.

Several factors such as linear density, the maturity of the cotton fibers and the like may affect the micronaire values.

The micronaire value is measured using, for example, a SHEFFIELD Micronaire apparatus and observing a method defined, for example, by ISO 2403 or NF G 07-073.

This micronaire value defines cotton fiber fineness. It is measured in terms of the air permeability of a mass of cotton under given, specific conditions, using an arbitrary, so-called micronaire scale which is calibrated by means of a number of cottons (about a dozen standard cottons) which under International agreement were assigned micronaire values. The air permeability of a given sample taken from an outer layer of the product of the invention, which constitutes the test specimen, is measured by reading the airflow drag in the air-flow device from a scale which is graduated in terms of air output or pressure differential. This scale was previously calibrated using the series of reference cottons.

The apparatus includes a scale to measure the weight of the specimen, an airflow device to measure the micronaire value and consisting of a perforated compression cylinder containing the specimen and devices, such as an air pump, to measure the specimen's air permeability, means regulating the airflow or pressure through the specimen into the compression cylinder, a manometer to detect the required pressure differential and a flow meter to read the air flow through the specimen, and where desirable a graduated scale of the micronaire values or a table converting the collected data into micronaire values. Sampling and specimen collection illustratively are carried out in the manner of the standards NF G 07-050 and NF G 07-062.

Thereupon the weight of the specimens is ascertained. Uniformly and in small amounts, the specimen is introduced into the compression cylinder and the fiber-compressing piston is put in place and then locked. The air feed is applied at the appropriate pressure or output and the pressure differential is read off the instrument scale.

As regards apparatus of which the scale is graduated in micronaire values, the mean of the readings for the set of samples taken from the same sample is then calculated. As regards apparatus of which the scale is graduated in other units than micronaire values, the direct readings that were taken will be converted by means of the conversion curve into micronaire values.

The micronaire value, which denotes the mean fiber weight per unit length, is stated in $\mu$g/inch.

The first layer of the product of the invention is cotton fibers of a micronaire value between 2 and 5 $\mu$g/inch, preferably between 2.8 and 4.2 $\mu$g/inch.

The second layer is cotton fibers exhibiting a higher micronaire value between 4 and 10 $\mu$g/inch, preferably between 5 and 8.5 $\mu$g/inch. For significant differences between the two product sides, the required differential between the two micronaire values of the two outer layers is estimated as being at least 1 $\mu$g/inch.

To determine the micronaire value, it was stated in deci-tex, which also is a measure of the weight of a fiber or filament per unit length, however relating specifically to artificial and synthetic fibers. These latter fibers exhibit a regular contour, unlike the natural fibers of which the cross-section varies and depends on their maturity. For one tested sample, the test procedure is defined by ASTM D3818-79 (fineness and maturity coefficient of cotton fibers), the fineness of the cotton fibers exhibiting a mean micronaire value of 7.82 $\mu$g/inch and used for an outer layer constituting the scraping surface was measured. The fineness or titer of the fibers was estimated as being 4.04 dtex, a magnitude lower than the titer of the synthetic fibers used in the scraping side of the wiping products described in European Patent Application 0 826 811.

The cotton layers or sheets constituting the product of the invention may exhibit identical or different specific surface weights. Illustratively the first soft-fiber layer exhibiting a low micronaire value may have a specific surface weight between 10 and 40 g/m$^2$ and the second scraping-fiber layer may have a specific surface weight between 10 and 300 g/m$^2$. Vice-versa, the soft fiber layer's specific surface weight may be between 10 and 300 g/m$^2$ and the scraping layer's specific surface weight between 10 and 40 g/m$^2$.

Another embodiment illustrated in FIG. 1 is a makeup removing product 1 comprising two layers. The first outer layer 2 exhibits a low micronaire value and the second outer layer 3 a high one. The specific surface weight of each of these two layers is between 50 and 250 g/m$^2$.

The product of the invention also may comprise more than two layers. If so, one or more core layers are sandwiched between the two outer layers, provided that the micronaire values of each of the two outer layers is different in order to attain one soft side and one side which provides more scraping.

It is important that the outer layers exhibit a specific surface weight of at least 8 g/m$^2$ in order that they be significantly different and further to neutralize the feel of the core layer or of one of the outer layers: Increasing the specific surface weight of each outer layer enhances their differentiation while precluding a loss in the desired effect such as attained through the soft fibers of an outer layer in contact with the other outer layer made of so-called scraping fibers and exhibiting too low a specific surface weight, or the effect attained by a core layer of average micronaire value, or the effect produced by the soft fibers of a core layer configured just underneath an outer layer made up of so-called scraping fibers and of an insufficient specific surface weight.

FIGS. 2 through 5 illustrate product embodiments having more than two layers.

FIG. 2 schematically shows a cross-section of a product 4 having three cotton layers. The specific surface weight of the first outer layer 5 is between 10 and 40 g/m$^2$, the layer's micronaire value being low. The specific surface weight of the second outer layer 6 also runs between 10 and 40 g/m$^2$, but this layer exhibits a high micronaire value. The core layer 7 sandwiched between the two outer layers exhibits a specific surface weight between 50 and 300 g/m$^2$.

FIG. 3 schematically shows a cross-section of another product 8 comprising three layers. In this embodiment the specific surface weight of the first layer 9 is between 10 and 40 g/m$^2$ and this layer exhibits a low micronaire value whereas the second outer layer 10 has a specific surface weight between 50 and 200 g/m$^2$ and a higher micronaire value. The core layer 11 sandwiched between the two outer layers has a specific surface weight between 50 and 200 g/m$^2$.

FIG. 4 is a cross-section of another embodiment of the invention. This product 12 is composed of three layers, namely an outer layer 13 of which the specific surface weight is between 10 and 40 g/m$^2$ and the micronaire value is high, and another outer layer 14 of which the specific surface weight is between 50 and 200 g/m$^2$ and the micronaire value is low, said outer layers enclosing a core layer 15 of which the specific surface weight is between 50 and 200 g/m$^2$.

Lastly FIG. 5 shows a cross-section of a product 16 exhibiting four cotton layers. The first outer layer 17 has a low micronaire value and the second outer layer 18 has a high micronaire value, both layers exhibiting a specific surface weight between 10 and 40 g/m$^2$. Furthermore the product includes two core layers 19 and 20 each with a specific surface weight between 50 and 200 g/m$^2$ and both sandwiched between the two outer layers.

The manufacturing process for the products of the invention involves preparing at least two sheets of cotton fibers constituting the outer product layers, one of which exhibits a low micronaire value and the other a higher one. The micronaire value differential of the two outer layers is at least 1 $\mu$g/inch. The sheets may be formed directly from bleached, hydrophilic cotton. They may also be made from raw, ecru cotton and then be treated chemically in order to attain a hydrophilic and bleached condition. Following sheet formation, the cotton sheets are superposed and then are combined in any known, conventional manner, for example by bonding or by mechanical means such as calendering or needling. Moreover they may be combined hydraulically. Again good combination can be attained by impregnating the superposed sheets using any known conventional means, for example moving them through an impregnation bath or atomizing such means on them, or pouring a solution on them. This impregnation must be in conjunction with expression compacting the sheet and eliminating part of the liquid contained in the moist sheet, for example by calendering or by being moved over a vacuum slit. A process for continuously manufacturing and combining sheets is described in applicant's European Patent 0 681 621. In that document, the sheets are impregnated during their various chemical processings and then are combined.

Preferably the sheets are combined hydraulically, that is using high-pressure water jets in conjunction with vacuum expression. Such combination may be implemented using a commercial system ICBT-PERFOJET (Grenoble, France). This particular technique allows combining the two sheets together and connecting at least one surface of the sheet, whereby product lint is reduced.

For the case of an ecru fiber that is treated chemically, the stage of hydraulic linking can take place immediately after sheet impregnation in the manner described in European Patent Application 0 735 175. It can also undergo a final rinsing stage in the manner of the applicant's European Patent 0 805 888.

The sheets that are thus combined in any conventional manner are then cut into formatted products.

One of the advantages offered by the product of the present invention is its 100% content of cotton fibers. As a result, the cutting wastes are easily recycled to form new products.

By seizing and feeling the product, the consumer easily can differentiate between the soft and the scraping surfaces.

To emphasize this difference, a softening agent may be atomized solely onto the soft product side. Consequently the composition of the first outer layer with a low micronaire value will include a softener which is spread substantially at the surface of this layer.

Also visual differentiation using a variety of different means may be carried out.

Illustratively the outer layers may be dyed before-hand in different colors or only one may be dyed and the other may remain white.

Be it also noted that one of the outer surfaces may be marked by pressure imprinting. Procedures resorting to engraved, optionally heated, cylinders or calendering equipment or even marking canvases may be used.

Preferably however the hydraulic linking technique already discussed above to combine the sheets and to avert linting are used to visually differentiate the two product sides.

If so, this single technique will allow meeting three different functions:

The different layers are prepared and then superposed; the assembly is impregnated. Next the two outer layers are hydraulically linked one after the other on endless belts or cylinders.

The hydraulic linking technique allows treating the two sides differentially. The high-pressure water jets used to interlace the fibers of the outer layers striate the surfaces of these layers with striations visible to the naked eye, the distances between the striations corresponding to the distances between the jet axes. More specifically, the hydraulic linking apparatus includes a high-pressure pump feeding an injector configured transversely to the direction of advance of the sheet or layer of fibers, such feed being applied across the full width of the sheet/layer. The injector is in the form of a pressurized volume of water sealed by a steel strip comprising calibrated holes which generate water jets in the form of thin, high-pressure needles of water thrust perpendicularly to the surface of the fiber sheet. These fine jets tangle the fibers. The diameters of the holes perforating this steel strip run from 100 to 200 $\mu$m, preferably from 120 to 140 $\mu$m, and are distributed regularly. In general, the distance between the axes of two consecutive holes of this steel strip is between 0.5 and 3 mm, most often between 0.6 and 1 mm. Because the injector is stationary and the cotton sheet or layer moves underneath it, the layer surface comprises a series of parallel striations or grooves corresponding to its motion underneath the jets.

In this manner distance can be changed between the axes of the strip holes of a hydraulic linking device used in processing one outer layer relative to the device processing the other layer.

In order to attain different appearances between the two product sides, for example, one hydraulic linking device can be used with a strip of which the holes are apart by a large distance of 1.2 to 3 mm, preferably 1.6 to 2.5 mm, and another such device can be used for the other side, of which the strip is perforated with holes that are apart by a distance between 0.4 and 1.2 mm, preferably between 0.5 and 0.8 mm. The striations or grooves apart by 1.2 to 3 mm are more visibly marked on their side than the striations on the other side.

In this way one side is finely striated and the other coarsely.

FIG. 6 illustrates a product embodiment with such differentiation.

This product 21 comprises a first outer layer 22 exhibiting a micronaire value of 3.4 $\mu$g/inch and a specific surface weight of 25 g/m$^2$, a second outer layer 23 having a micronaire value of 6.8 $\mu$g/inch and a specific surface weight of 25 g/m$^2$ and a core layer with a specific surface weight of 24 to 200 g/m$^2$.

Side 25 of the outer layer 22 exhibits striations 26 that are apart one from another by a distance $d_1$ of 0.6 mm and side 27 of the outer layer 23 exhibits striations 28 which are apart form each other by distance $d_2$ of 2 mm.

In this manner the consumer can distinguish the soft side from the more scraping side of the product in order to make use of them as appropriate, namely for makeup deposition and/or makeup removal.

However it follows directly from the increase in distance between the holes of the perforated strip that there is a lesser number of holes and, accordingly, less energy applied to the sheet, and this decrease in energy cannot always be compensated by increasing the water pressure in the injector. This decrease in energy applied to the sheet can increase linting compared to a sheet that was hydraulically linked using a perforated strip of which the hole separation is small and uniform. In order to limit this increase in linting, the strip being used can configure the holes in a particular sequence, for example in sets of 6 holes mutually apart by 0.6 mm, with each set in turn being spaced from the next one by 1.8 mm. In this manner a side is produced with very visible striations because being widely apart, the "pitch" is large and about 4.8 mm. In this manner an increase in linting is restricted thanks to a mean hole occurrence exceeding that of a regularly perforated strip, illustratively with holes 1.8 mm apart. In this illustrative sequence, the mean number of holes per meter is 1,250 whereas in the case of holes regularly spaced apart by 1.8 mm, such a number is 555. For a given hole diameter and a given pressure, a strip fitted with such a sequence will allow applying more than twice the energy which is applied by the strip regularly perforated at 1.8 mm spacings.

FIG. 7 illustrates a strip perforated in a sequence which in this embodiment consists of a set of five holes which are mutually apart by a distance $e_1$ of 0.6 mm, each sequence or set of holes being apart from the next sequence by a distance $e_2$ of 1.8 mm.

This particular product therefore exhibits a first outer layer comprising striations which are mutually apart by 0.4 to 1.2 mm, in this case by 0.6 mm, and a second outer layer comprising striations in a sequence including several sets of striations, each set of striations being a given distance apart from the adjacent one by 0.4 to 1.2 mm, in this instance 0.6 mm, and each set is apart from the following set by a distance between 1.2 and 4 mm, in this case 1.8 mm.

Accordingly, the consumer is being offered a cotton product of which the two sides are distinguishable and which retains its mechanical qualities, namely anti-linting, cohesiveness (anti-delamination) and softness even when one of the sides when used for cleansing is more scraping than the other.

What is claimed is:

1. A hydrophilic cotton product of 100% cotton fibers comprising at least one first outer layer and at least one second outer layer, wherein the first outer layer comprises fine fibers exhibiting a low micronaire value and providing a soft side to said product, and the second outer layer comprising fibers exhibiting a micronaire value higher than the low micronaire value of the first outer layer and providing a scraping surface to said product.

2. Product as claimed in claim 1, wherein the first outer layer exhibits a micronaire value between 2 and 5 $\mu$g/inch and the second outer layer exhibits a micronaire value between 4 and 10 $\mu$g/inch, and wherein a differential of micronaire values for the first outer layer and the second outer layer is at least 1 $\mu$g/inch.

3. Product as claimed in claim 2, wherein the first outer layer exhibits a micronaire value between 2.8 and 4.2 $\mu$g/inch and the second outer layer exhibits a micronaire value between 5 and 8.5 $\mu$g/inch.

4. Product as claimed in claim 1, 2 or 3, wherein the first outer layer and the second outer layer each have a specific surface weight of at least 8 g/m$^2$.

5. Product as claimed in claim 1, 2 or 3, further comprising at least one core layer present between the first outer layer and the second outer layer.

6. Product as claimed in claim 1, 2 or 3, wherein each of the first outer layer and the second outer layer further comprise surface striations wherein spacing between striations of one of the first outer layer or the second outer layer is less than spacing between striations of the other layer.

7. Product as claimed in claim 6, wherein the spacing between the striations of the first outer layer is between 0.4 and 1.2 mm and the spacing between the striations of the second outer layer is between 1.2 and 3 mm.

8. Product as claimed in claim 6, wherein the first outer layer comprises striations of mutual spacings between 0.4 and 1.2 mm and the second outer layer comprises striations in a sequence comprising several sets of striations, each set of striations exhibiting a spacing between striations that is between 0.4 and 1.2 mm and each set of striations is spaced from a next set of striations by a distance of between 1.2 and 4 mm.

9. Product as claimed in claim 1, 2 or 3, wherein at least one of the first outer layer or the second outer layer is embossed.

10. Product as claimed in claim 6, wherein at least one of the first outer layer or the second outer layer is embossed.

11. Product as claimed in claim 1, wherein the first outer layer of low micronaire value further comprises a softening agent which is present substantially at an outward surface of the layer.

12. A method for manufacturing a hydrophilic cotton product as claimed in claim 6 comprising hydraulically linking each of the first outer layer and the second outer layer by water jets wherein axes of said water jets are mutually spaced apart by a distance that differs for the water jets used on the first outer layer and the water jets used on the second outer layer in such a way that the first outer layer and the second outer layer so made include surface striations of different inter-spacings.

13. Product as claimed in claim 1, 2 or 3, wherein said product comprises a deposition and/or makeup removal product.

14. Product as claimed in claim 6, wherein said product comprises a deposition and/or makeup removal product.

* * * * *